United States Patent [19]

Villar

[11] 4,156,227

[45] May 22, 1979

[54] JOGGING SWITCH MECHANISM

[75] Inventor: Luis F. Villar, Westbury, N.Y.

[73] Assignee: Servo Corporation of America, Hicksville, N.Y.

[21] Appl. No.: 905,273

[22] Filed: May 12, 1978

[51] Int. Cl.[2] ..... H01C 10/50

[52] U.S. Cl. ..... 338/198; 338/172; 338/200; 338/215

[58] Field of Search ..... 338/198, 172, 200, 215, 338/191; 200/153 T, 153 G

[56] References Cited

U.S. PATENT DOCUMENTS 4,047,145 9/1977 Schwehr ..... 338/67

*Primary Examiner*—C. L. Albritton

[57] ABSTRACT

A jogging switch mechanism is provided for a potentiometer which permits the potentiometer shaft to be rotated either clockwise or counterclockwise and then, upon release, to return automatically to a very accurately centered neutral position. The neutral position may be an "off" position by positioning micro switches in the path of travel of the switch mechanism.

6 Claims, 3 Drawing Figures

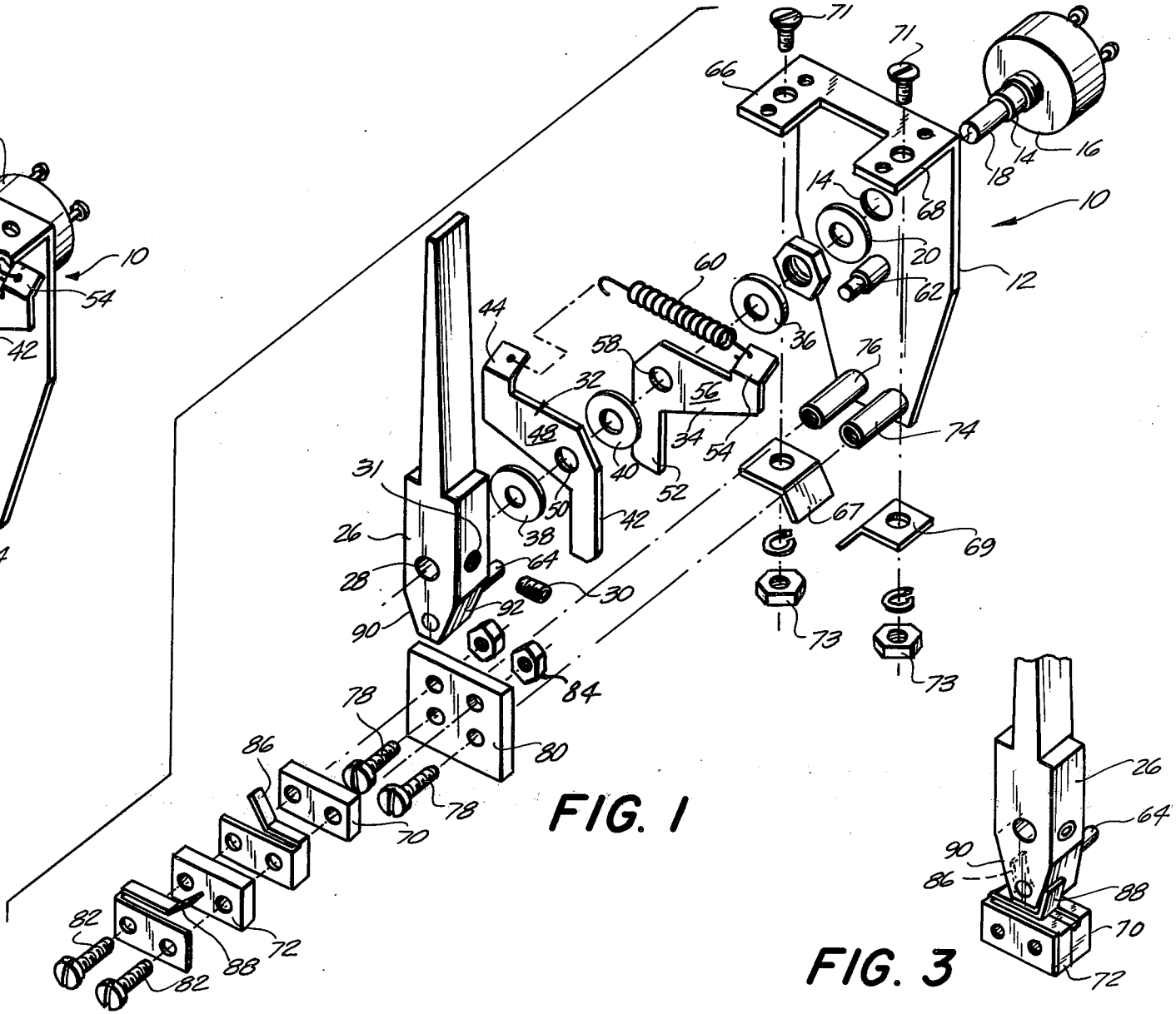
FIG. 1
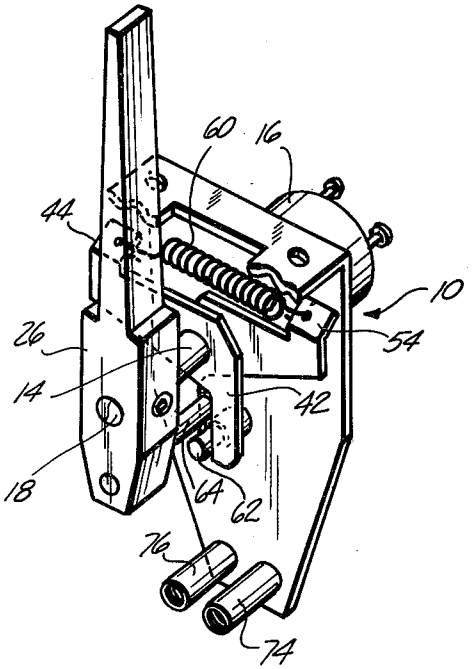
FIG. 2
FIG. 3

JOGGING SWITCH MECHANISM

BACKGROUND OF THE INVENTION

The present invention relates to switches and in particular to a mechanism for use with a potentiometer or other rotary component which automatically returns the potentiometer shaft to a preselected neutral position after offset and release.

There are many applications, such as in the tape editing field, wherein an operator is called upon to make temporary adjustments in an electrical control setting after which it is necessary for the control setting to be returned to its original or a neutral position. The neutral position may be an "on" or "off" position which is the normal position for the component. In many electrical and electronic applications, such a control may be a potentiometer which is used to fine tune or fine adjust a setting. In the tape editing field, a potentiometer may, for example, be used to govern the speed and direction of tape travel so that during editing, an operator can rapidly advance forward or backward as required to precisely locate information needed on the tape.

The need for a jogging mechanism of the type described is well known and various attempts have been made to provide for such a mechanism. Such devices are disclosed, for example, in U.S. Pat. Nos. 2,761,026; 3,585,319; 3,587,027; 3,622,727; 3,828,148; and, 3,983,743. These prior art devices, however, have several shortcomings including the fact that they are relatively costly and require special components. In addition, the neutral position of such prior art devices is a fixed position which cannot readily be adjusted.

In view of the above, it is the principal object of the present invention to provide a mechanism for a conventional potentiometer which serves to automatically return the potentiometer to any preselected neutral position after rotation and release.

A further object is to provide such a mechanism which is operable to return the potentiometer to the selected neutral position after either clockwise or counterclockwise rotation.

A further object is to provide a mechanism which is relatively simple and inexpensive and which may be used with conventional components.

Still further objects and advantages will become apparent from a review of the following disclosure.

SUMMARY OF THE INVENTION

In accordance with the present invention, the above and other beneficial objects and advantages are attained by providing an improved simplified mechanism for returning the shaft of a rotary component to a neutral position after offset from the neutral position and release. The mechanism comprises a plate or bracket having surfaces defining an opening through which the shaft extends. A lever is secured to the shaft to rotate therewith. A first pin is affixed to the plate extending toward the lever and a second pin of equal diameter is affixed to the lever extending toward the plate. The pins extend substantially parallel and adjacent to each other. First and second generally "N" shaped detent members are mounted scissor-fashion about the shaft disposed between the lever and the plate. Each of the detents has first portions abutting both the plate pin and lever pin and second portions on opposite sides of the shaft from the first portions. A tension spring resiliently biases the detent second portions toward each other thereby serving to urge the detent first portions to abut against the plate and lever pins. With the detents in this position, the shaft is in a neutral position to which it will automatically return after release if rotated clockwise or counterclockwise. Micro switches are positioned in the path of travel of the lever so that upon return of the lever to its neutral position the component is turned off.

BRIEF DESCRIPTION OF THE DRAWINGS

The present invention is depicted in the accompanying drawings wherein:

FIG. 1 is an exploded perspective view of a jogging switch mechanism in accordance with the present invention;

FIG. 2 is a perspective view of the present mechanism assembled. The micro switches disclosed in FIG. 1 have been removed from the embodiment of FIG. 2 to more clearly show the relationship between the remaining components; and, FIG. 3 is a fragmentary perspective view of a portion of the present mechanism assembled to show the relationship between the mechanism lever and micro switches.

DETAILED DESCRIPTION OF THE PREFERRED EMBODIMENT

Reference is now made to the drawings wherein a jogging mechanism in accordance with the present invention is disclosed. The jogging mechanism generally designated by the numeral 10 comprises a generally flat plate 12 having a circular opening 14 cut therein. A conventional potentiometer 16 is mounted to the rear of the plate with its shaft 18 extending through the opening. The potentiometer is mounted in the usual manner and is secured in position by washer 20 and nut 22 which engage a threaded sleeve 24 secured to the potentiometer body. While the present invention is being discussed in connection with a potentiometer, it should be readily understood that the present jogging switch may be utilized with any rotary component (i.e., a device wherein adjustments are made by rotating a shaft member).

A lever 26 is secured to the potentiometer shaft 18. In this connection, lever 26 is provided with a circular opening 28 which closely fits about shaft 18. The lever is secured to the shaft by a set screw 30 which passes through a threaded opening 31 in a side of the lever to engage the portion of shaft 18 that passes through opening 28.

A pair of detent members 32 and 34 are mounted scissor-fashion about shaft 18 and are disposed between plate 12 and lever 26. Washers 36, 38 and 40 are interleaved between the detents, lever and nut 22 to insure the smooth rotational movement of the detents during the operation that will be described forthwith. Each of the detents is generally "N" shaped. Thus, detent 32 has a first portion 42 extending downwardly from one end of a horizontal portion 48 and a second portion 44 extending upwardly from the other end of the center horizontal portion. An opening 50 is provided at the juncture of the downwardly extending first portion 42 and horizontal portion 48. In a similar fashion, detent 34 has a first portion 52 extending downwardly from one end of a horizontal portion 56 and has from the other end of a second portion 54 extending upwardly the center horizontal portion. An opening 58 is provided at the junction of the downwardly extending portion 52 and horizontal portion 56.

Shaft 18 passes through openings 50 and 58 of detents 32 and 34 with the detents mirror-imaged about the shaft. The "scissor" like mounting of the detents about the shaft is such that when the detent second portions 44 and 54 are moved toward each other, the detent first portions 42 and 52 similarly move toward each other. Similarly, when the second portions are moved apart, the first portions move apart.

A tension spring 60 extends between the upper ends of the detent second portions 44 and 54 and is secured to each of the second portions.

A pin 62 extends from plate 12 toward lever 26. Similarly, a pin 64 extends from lever 26 toward plate 12. The pins 62 and 64 are of the same diameter and are oriented to lie adjacent one another when the mechanism is in the assembled condition shown in FIG. 2. In addition, the pins are positioned to lie between the first portions 42 and 52 of detents 32 and 34.

In operation, when lever 26 is rotated either clockwise or counterclockwise, potentiometer shaft 18 will rotate with the lever by virtue of set screw 30 securing shaft 18 to lever 26. In the normal or neutral position, pins 62 and 64 are aligned parallel to first portions 42 and 52 of detents 32 and 34 and both first portions abut both pins. As lever 26 is rotated, its pin 64 is forced against the first portion of one of the detents (depending upon whether the rotation is clockwise or counterclockwise) and away from the first portion of the other detent. The detent against which the pin 64 is forced will rotate with the lever and thereby impact tension into spring 60. The other detent is prevented from rotating by pin 62 of plate 12 which is fixed with respect to the lever. When pressure on lever 26 is released, the force of spring 60 returns the detent that rotated with the lever back to the starting position until its first portion once again abuts pin 62. The rotation of the detent to the start position now forces the lever 26 and hence shaft 18 to also return to the start position. The above operation occurs whether the lever is rotated clockwise or counterclockwise. The only difference is that when the lever is rotated clockwise, detent 34 will rotate with the lever and detent 32 will remain in place. Conversely, when lever 26 is rotated counterclockwise, detent 32 will rotate with it and detent 34 will remain in place.

The neutral or starting position is determined by the position of potentiometer shaft 18 when set screw 30 is tightened. If any adjustment in the potentiometer neutral position is required, set screw 30 need merely be loosened thus enabling the potentiometer shaft 18 to be adjusted free of lever 26 and thereby establishing a new neutral position.

In order to limit movement of lever 26, portions 66 and 68 of plate 12 are positioned in the path of rotation of lever 26. Lever 26 may thus be rotated counterclockwise until it abuts portion 66 or clockwise until it abuts portion 68. The degree of rotation of shaft 18 may thus be limited. Stops 67 and 69 secured to plate 12 by screws 71 and nuts 73 may also be positioned in the path of lever 26 to provide a more positive stop. It should be apparent that the limits of rotation of lever 26 may readily be set by suitably selecting the dimensions of stops 67 and 69. In addition, it should be noted that the limits in the clockwise and counterclockwise direction may be set independently of each other.

There are many applications wherein it is desirable that the neutral position for potentiometer 18 be an "off" position with any adjustment of the potentiometer serving to turn an associated circuit "on". To achieve this desired end, micro switches 70 and 72 may be mounted to plate 12 to be engaged by lever 26 as soon as the lever is shifted off-center. A pair of mounting lugs 74 and 76 are provided on plate 12. The lugs are spaced apart from each other and threaded to receive screws 78 which secure a bracket 80 to the lugs. Switches 70 and 72, in turn, are mounted to bracket 80 via screws 82 and nuts 84. The actuators for switches 70 and 72 are covered by extension members 86 and 88 which lie closely adjacent to opposite tapered sides 90 and 92 of the lower end of lever 26 when the lever is in its neutral position. The extensions 86 and 88 are contoured to closely parallel the tapered sides 90 and 92 of lever 26 so that slight movement of the lever off its neutral position will be transmitted to trip micro switches 70 and 72. Lugs 74 and 76 are sufficiently long to position the micro switches under the lever tapered surfaces.

Thus, in the fully assembled unit, when the jogging mechanism is in its neutral position, shaft 18 of potentiometers 16 is in the predetermined neutral position. The lower tapered sides 90 and 92 of lever 26 nestle between the extensions 86 and 88 of the micro switches without engaging either so that the micro switches 70 and 72 remain open (or closed if desired). When lever 26 is rotated clockwise or counterclockwise one of the tapered surfaces 90 or 92 is forced to engage an extension 86 or 88 to trip micro switch 70 or 72. When pressure on the lever 26 is released, spring 60 restores the lever to its neutral position through the previously described action and the potentiometer and micro switches are also reset.

Thus, in accordance with the above, the aforementioned objects are effectively attained.

Having thus described the invention, what is claimed is:

1. A mechanism for returning the shaft of a rotary component to a neutral position comprising: a shaft of said rotary component a plate;

surfaces of said plate defining an opening through which said shaft extends;

a lever secured to said shaft to rotate therewith;

a pin affixed to said plate extending toward said lever;

a pin affixed to said lever extending toward said plate;

first and second detent members mounted scissor-fashion about said shaft disposed between said lever and said plate, each of said detents having first portions abutting said plate pin and said lever pin and second portions on opposite sides of said shaft from said first portions; and, spring means resiliently biasing said detent second portions toward each other and said detent first portions against said plate and lever pins whereby to define said neutral position.

2. The mechanism in accordance with claim 1 wherein said rotary component comprises a potentiometer and further comprising first and second switch means secured to said plate, said switch means having portions disposed in the path of rotation of said lever adapted to be actuated when said lever is rotated off said neutral position.

3. The mechanism in accordance with claim 2 wherein said potentiometer is secured to said plate.

4. The mechanism in accordance with claim 1 wherein said plate includes portions thereof disposed in the path of rotation of said lever, limiting the rotation of said lever.

5. The mechanism in accordance with claim 1 wherein said lever is removably secured to said shaft.

6. The mechanism in accordance with claim 1 wherein said lever pin and plate pin are of equal diameter and extend adjacent to each other.

* * * * *